United States Patent [19]

Alberico et al.

[11] Patent Number: 4,466,213

[45] Date of Patent: Aug. 21, 1984

[54] AERIAL FLIGHT DEVICE

[76] Inventors: Dominec Alberico, 1103 Garfield St., Lockport, Ill. 60441; Jack A. Albert, 323 Pasadena Ave., Crest Hill, Ill. 60435

[21] Appl. No.: 505,284

[22] Filed: Jun. 17, 1983

[51] Int. Cl.[3] ..... A63H 27/00; A63H 27/14

[52] U.S. Cl. ..... 446/56; 46/64

[58] Field of Search ..... 273/428; 46/81, 74 A, 46/74 B, 74 C, 79, 74 R, 76 A; 102/347, 348, 349

[56] References Cited

U.S. PATENT DOCUMENTS

| | | | |
|---|---|---|---|
| 2,298,425 | 10/1942 | Shaffer | 46/81 |
| 2,364,498 | 12/1944 | Walker | 46/79 |
| 2,752,729 | 7/1956 | MacInnes | 273/428 X |
| 2,899,773 | 8/1959 | Lockwood | 46/74 R |
| 2,921,404 | 1/1960 | Lescher | 46/74 R |
| 2,927,398 | 3/1960 | Kaye et al. | 46/74 C |
| 3,119,196 | 1/1964 | Alberico | 46/74 R |
| 3,942,441 | 3/1976 | Senoski | 46/74 A X |
| 4,295,290 | 10/1981 | Boswell | 46/74 C |
| 4,356,662 | 11/1982 | Strasser et al. | 46/81 X |

*Primary Examiner*—F. Barry Shay

*Attorney, Agent, or Firm*—A. G. Douvas

[57] ABSTRACT

Two embodiments of a toylike aerial flight device having a simulated rocket configuration are described. The first embodiment is manually powered and the second embodiment is powered by a solid-fuel propellant cartridge having a thrust charge and a retro-fire charge. Both embodiments follow similar flight paths, namely, a substantially linear elevating launch to the crest of flight followed by a slow gyrating descent. Both embodiments have a head projecting forwardly from the body, a pair of swept-back wings symmetrically disposed relative the body, and a pair of weight segments whose position relative the center of gravity of the flight device is fairly critical. In the solid-fuel powered device, the retro-fire charge is ignited at about the crest of flight to tilt the head about a pivot hinge. This tilting action promotes gyrating flight.

13 Claims, 13 Drawing Figures

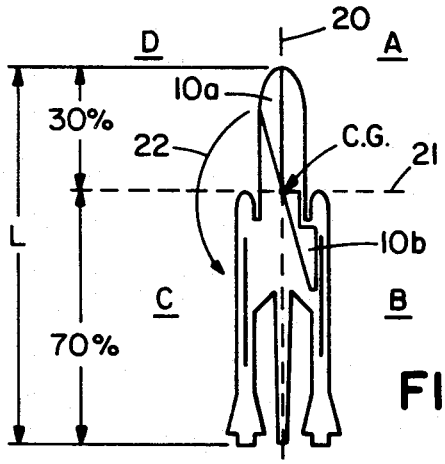
FIG.6
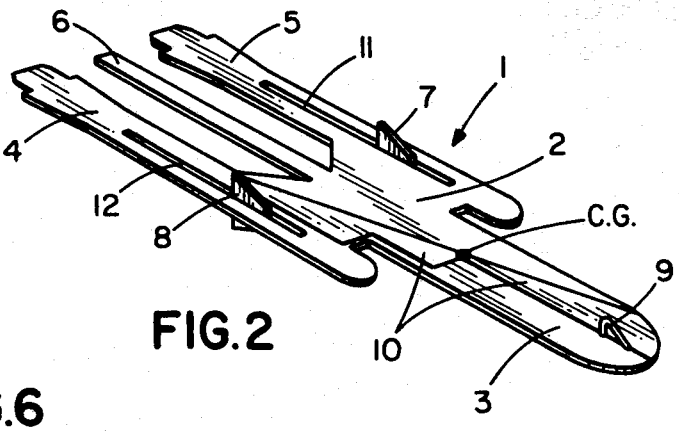
FIG.2
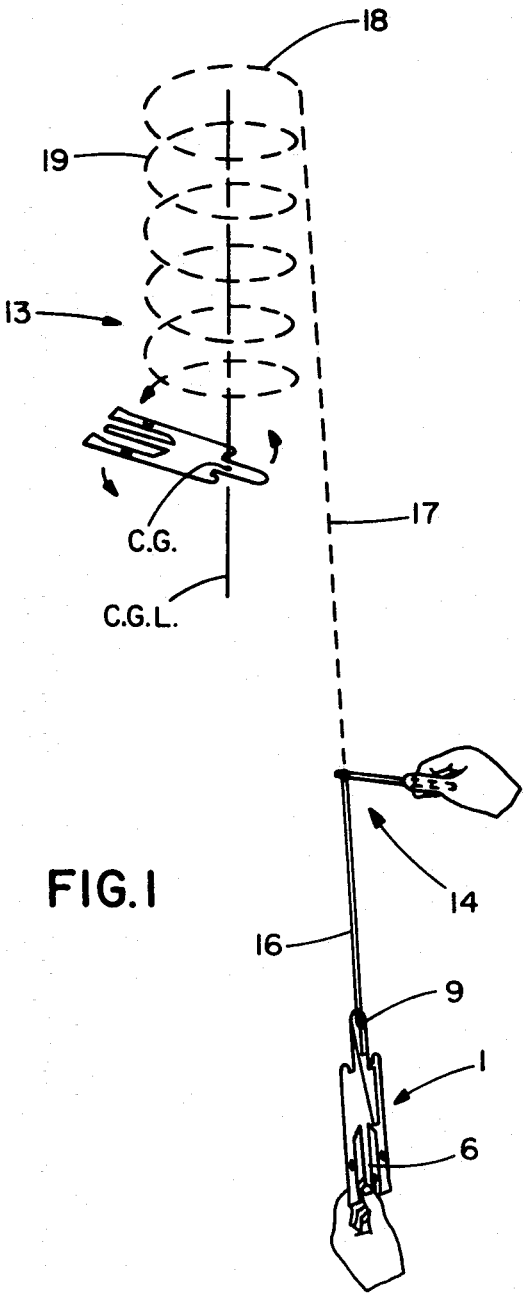
FIG.1
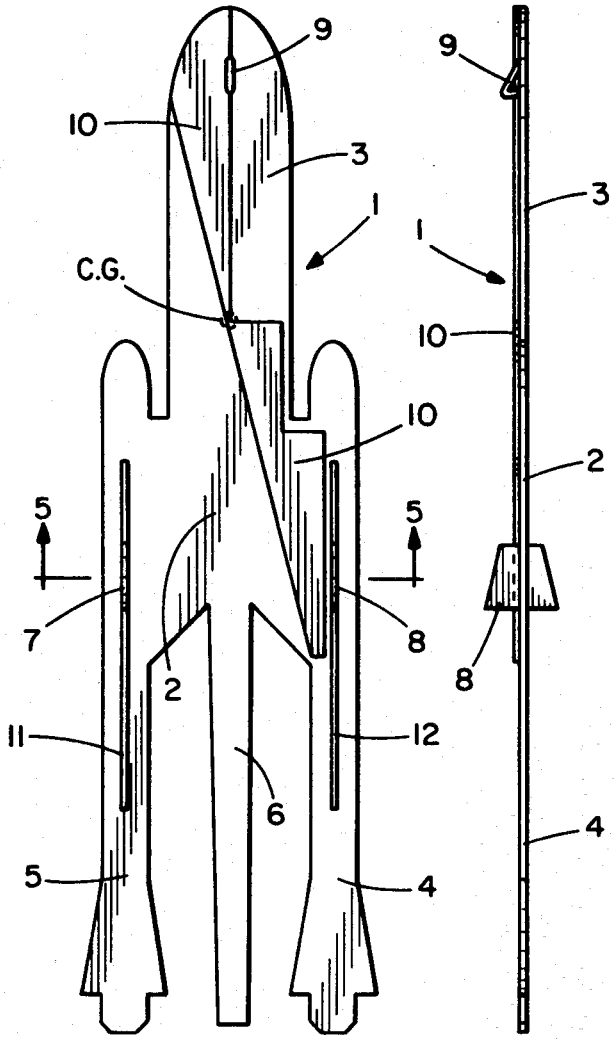
FIG.3
FIG.4
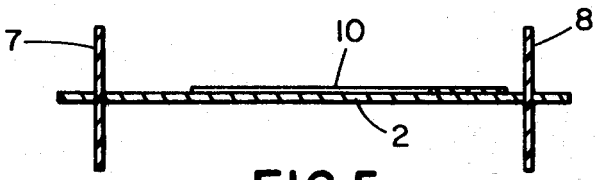
FIG.5

AERIAL FLIGHT DEVICE

Background of the Invention

This invention relates to relatively small aerial flight devices which may be used as toys, information carriers, or flight instructional aids.

The prior art is prolific in toylike devices which are launched into flight by either manual power or ignition of a cartridge containing a solid-fuel propellant. A preferred and commonplace flight path includes a linear vertical ascent followed by a slowly gyrating descent. Prior art patents of interest include U.S. Pat. Nos. 4,295,290, 3,942,441, 3,119,196 and 2,921,404.

With the recent popularity of toy rockets characterized by a projecting rocket head joined to a plurality of swept-back wings, there is an apparent demand for designs of that configuration which are lifted in a linear path to descend slowly and safely in a gyrating spiral.

Summary of the Invention

Accordingly, a principal object of this invention is to provide an aerial flight device characterized by a rocketlike shape which is capable of a reliable vertical ascent followed by a gyrating slow and safe descent.

The novel features of this invention are applied to two embodiments. The first embodiment is manually powered, and the second is powered by a cartridge of solid fuel containing a thrust charge and a retro-fire charge.

Both embodiments follow essentially the same flight path, namely, a linear, vertical ascent and a slow gyrating descent. The gyrating descent is produced in both embodiments by locating a pair of weight segments in diagonally opposite quadrants relative coordinates having their origin at the center of gravity of the embodiment. The weights are fixed relative to one another in the manual powered embodiment, but in the solid-fuel powered device the retro-fire charge unlatches a hinged head to move a weight contained in the head to the proper position by tilting the head after the apex of vertical flight is attained.

Detailed Description of the Drawings

In order that all of the structural features for attaining the objects of this invention may be readily understood, reference is herein made to the drawings wherein:

FIG. 1 is a simplified drawing showing the flight path of the manual-powered flight device of the first embodiment of this invention;

FIG. 2 is a perspective view of the flight device of FIG. 1;

FIG. 3 is a plan view of the flight device of FIG. 1 including a superimposed outline of the concentrated weight which produces gyrational flight;

FIG. 4 is a side elevation view of the structure of FIG. 3;

FIG. 5 is a section view taken along line 5—5 of FIG. 3;

FIG. 6 is a diagram of assistance showing the disposition of the concentrated weight relative the center of gravity of the flight device;

Detailed Description of the Preferred Embodiments

Figure 7:
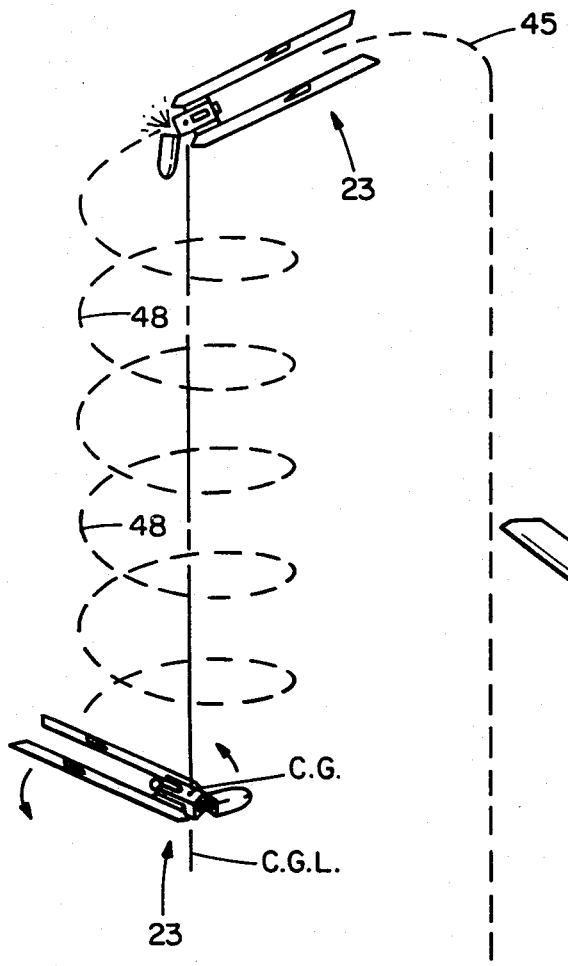
FIG. 7 is a simplified drawing showing the flight path of the rocket-powered flight device of the second embodiment of this invention.
Figure 8:
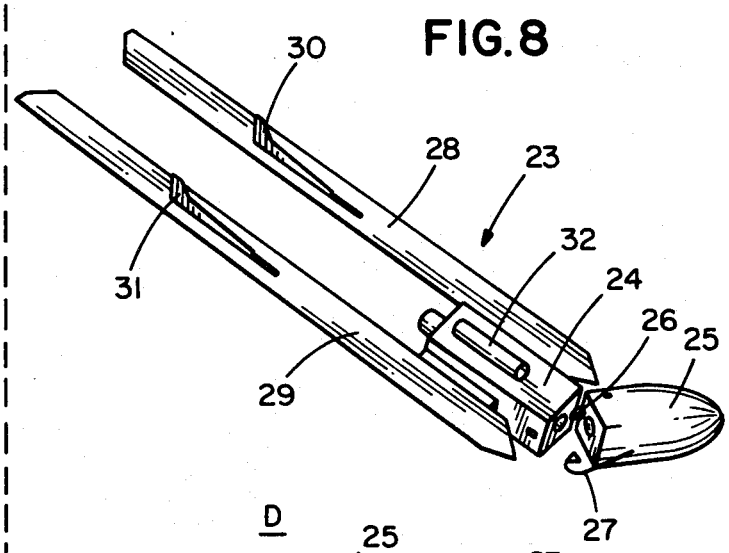
FIG. 8 is a perspective view of the rocket-powered flight device of FIG. 7 showing the head in a tilt condition necessary to insure gyrational flight.

The first embodiment of the flight device shown in the drawings (FIGS. 1–6) is launched manually, and the second embodiment shown in FIGS. 7–13 is rocket-powered using solid fuel as a propellant. Both embodiments structurally feature a forward head joined to two rearwardly swept wings.

In the case of the manual-powered flight device, launching power is supplied to the head by an extended rubber band. In the case of the rocket-powered flight device, launching power is supplied by a cartridge of solid fuel housed in a body section.

The general flight path of both embodiments is essentially the same. From the ground launching point to the apex of the launch, the flight path is essentially linear; thereafter, both devices follow a series of gravity-induced slow gyrations. As outlined hereafter in detail, the gyrations are produced in both embodiments by a disposition of weights which are essentially located in diagonally opposite quadrants (i.e., A and C, or B and D) with the origin being the center of gravity of the flight device. In the case of the rocket-powered flight device, the proper disposition of weight is effected by a second rocket charge which unlatches a hinged head to force the concentrated weight of the head into the optimum position to produce gyrations.

Referring now to manually-powered flight device 1 shown in FIGS. 1 through 6, the device comprises a body portion 2, a projecting head 3, a pair of symmetrically disposed swept-back wings 4 and 5, a hold tail 6, a pair of guide fins 7 and 8, a launch hook 9, and a gyration producing weight 10 having two segments **10*a* and 10*b* (FIG. 6**).

Elements 2, 3, 4, 5 and 6 are preferably formed in a single integral unit from light weight plastic, balsa wood, or cardboard. Wings 4 and 5 are each formed with a single elongated slot 11 or 12. Guide fin 7 is friction fitted within slot 11, and guide fin 8 is friction fitted within slot 12. Each fin is manually movable within its slot to vary the flight characteristics.

While satisfactory flights can be attained without the fins, inclusion of the fins adds to the vertical stability of flight device 1 enabling it to attain a higher vertical height before entering into gyrations. Fins 7 and 8 also provide compensation during the vertical flight phase for varying wind conditions. The fins are moved forwardly toward head 3 in low wind speed condition and rearwardly as the wind speed increases. The placement of fins 7 and 8 does not affect the gyration flight phase in any significant manner.

Flight device 1 is thrust into its flight path 13 (FIG. 1) by conventional hand launcher 14. Launcher 14 comprises a launching rod 16 and a rubber band 16. Rubber band 16 is elongated to initiate launch by elevating rod 15 while holding device 1 at the lower extremity of tail 6 and then releasing the tail. The resulting flight path includes a vertical portion 17 extending to apex or crest 18, and thereafter a series of helical gyrations 19 centered about the vertical descent line C.G.L. until flight device 1 is returned to ground.

The translation of vertical motion (at 17) into gyrations (at 19) depends principally upon the particular distribution of weight 10 about the center of gravity (C.G. FIGS. 2, 3, 6) of flight device 1.

The diagram of assistance of FIG. 6 contains an outline 20 of weight 10 and its two segments 10*a* and 10*b* which may be applied to the surface of or embedded in head 3 and body 2. Weight 10 may be, for example, a thin sheet of metal foil glued to the surface of head 3, or it may be an applied liquid which cures into a solid. Weight 10 should preferably be no thicker than the balsa wood or plastic from which the remaining portion of flight device 1 is constructed.

The center of gravity of flight device 1, including weight 10, is located at point C.G., which is an optimum location in the rear portion of head 3. Point C.G. is also located at the intersection or origin of longitudinal center line 20 and lateral line 21. Lateral line 21 is normal to center line 20, and the two intersecting lines divide the area into four quadrants: A, B, C and D. Weight 10 is composed of weight segments 10*a* and 10*b*. The mass of each of the weight segments must lie effectively in diagonally opposite quadrants; that is, either in quadrants B or D as shown, or alternatively in quadrants A or C.

The vectors of the moment arms generated by weight segments 10*a* and 10*b*, along the longitudinal center line 20 measured from point C.G. should be oppositely directed. Similarly, the vectors of the moment arms generated by weight segments 10*a* and 10*b* along the lateral line 21 measured from point C.G. should also be oppositely directed.

Longitudinally, point C.G. is located on longitudinal center line 20 at a point which is approximately 30% of the total length L from the tip of head 3 and 70% from the end of wings 4, 5 and hold tail 6. Laterally, point C.G. is located approximately midway of the wing span. There is some allowable tolerance in the longitudinal location of point C.G. to somewhere in the approximate range of 25% to 35% of length L from the tip of head 3 depending on the flight characteristics desired.

The theory of gyrating flight for device 1 is as follows: After flight device 1 attains crest or apex 18, the force of gravity exceeds the force of the vertical thrust, and the device assumes a slightly negative pitch with head 3 falling below the rear portion of the device. While the weight of the portion of the device forward lateral line 21 equals the weight to the rear of the lateral line, the rear portion has a much larger area subjected to aerodynamic lift. Since the major part of the lifting plane subject to aerodynamic lift lies behind lateral line 21, the rear of flight device 1 tilts upwardly and head 3 tilts downwardly. These turning moments develop a pitch angle which tends to become fixed.

Since any properly balanced lifting surface which falls through the air also begins to develop horizontal travel, this same effect translates into a horizontal movement around point C.G. which begins to serve as a pivot for the aerodynamic surface. This is observed as rotary motion in a counter-clockwise direction 22 as shown in FIG. 6.

Once rotary motion is initiated in a properly balanced device, it tends to become stabilized on a relatively horizontal plane with a relatively constant speed in response to a number of factors. One of these factors is the gyro effect created by the opposing and rotating weights diagonally positioned relative the C.G. point.

Rocket-powered flight device 23 shown in FIGS. 7 through 13, operates on the same general principles as hand-launched flight device 1 of FIGS. 1 through 6. There are, however, two specific differences in the mode of operation. First the ignition of a thrust charge of a solid-fuel propellant cartridge is used to achieve vertical flight, and second, a tilting head is used to insure a gyrating descent flight. The actuation of the head into its tilt position is attained by igniting a retro-fire charge of the propellant cartridge. Injury to an operator or spectators by a straight falling powered flight device is thus substantially eliminated.

Figure 9:
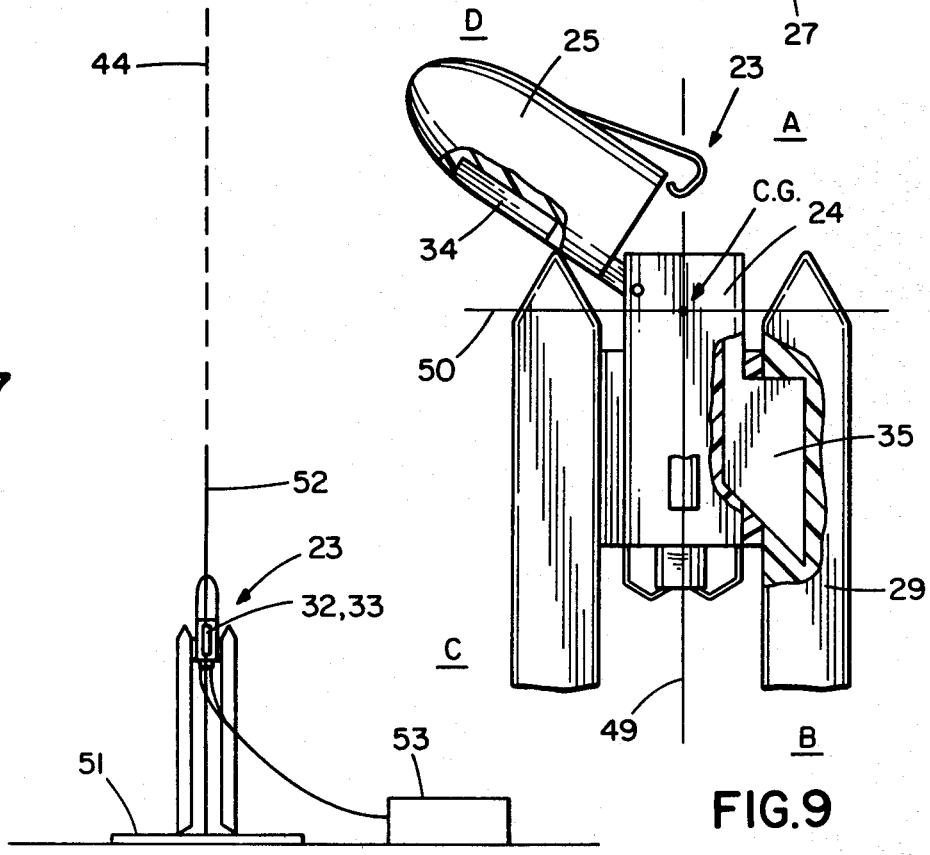
FIG. 9 is a diagram of assistance, similar to that of FIG. 6, showing the disposition of the concentrated weights relative the center of gravity of the rocket-powered flight device.
Figure 10:
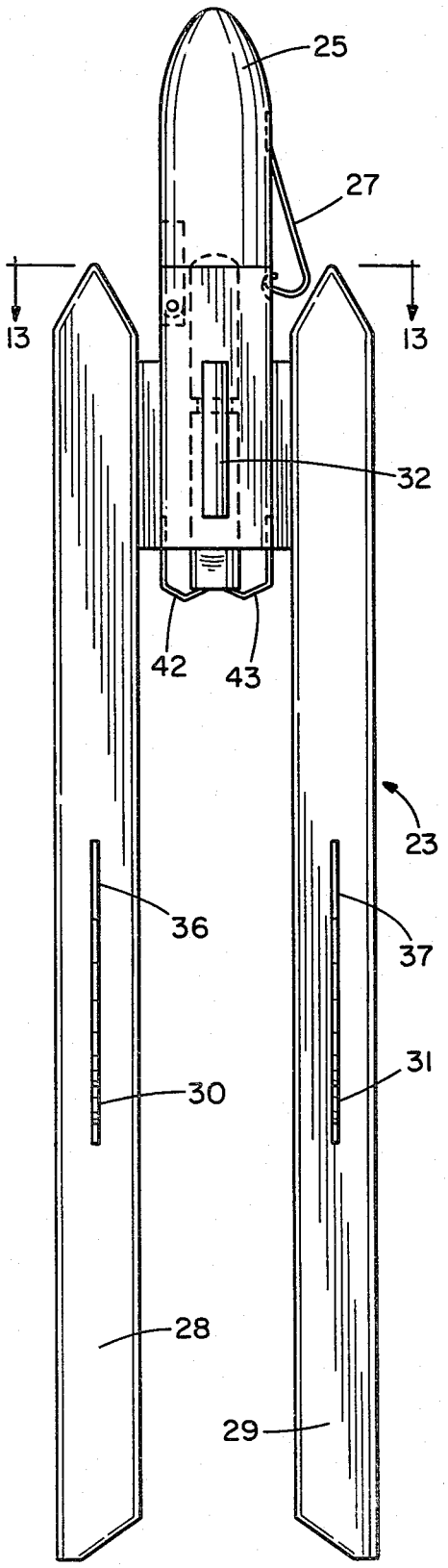
FIG. 10 is a plan view of the flight device of FIG. 7.
Figure 11:
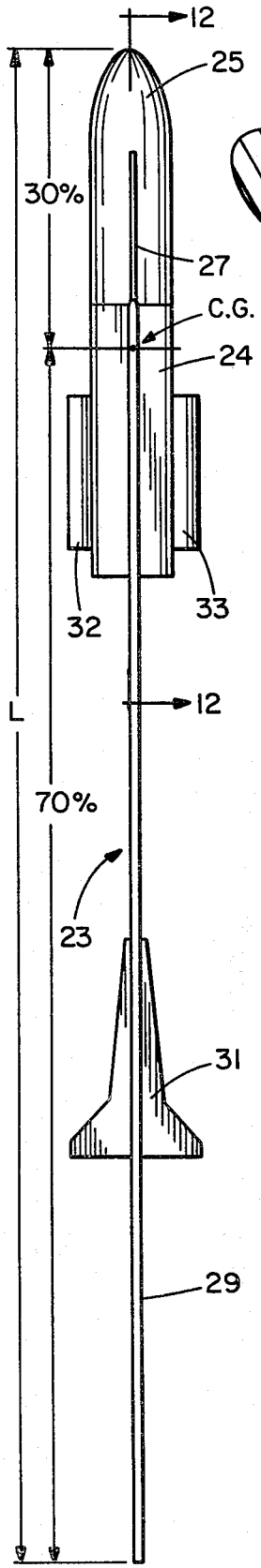
FIG. 11 is a side elevation view of the structure of FIG. 10.

Flight device 23 comprises a body 24, a projecting head 25 coupled to body 24 by hinge 26 and wire latch 27, a pair of symmetrically disposed swept-back wings 28 and 29, a pair of guide fins 30 and 31, a pair of launch guide tubes 32 and 33, and a pair of embedded weights 34 and 35 (FIG. 9).

Elements 24, 25, 28 and 29 are preferably formed from light weight plastic, or balsa wood. Wings 28 and 29 are each formed with a single elongated slot 36 or 37. Guide fin 30 is friction fitted within slot 36, and guide fin 31 is friction fitted within slot 37. Each fin is manually movable within its slot to vary the flight characteristics. In the case of flight device 23, successful flight cannot be attained without fins 30 and 31.

Figure 12:
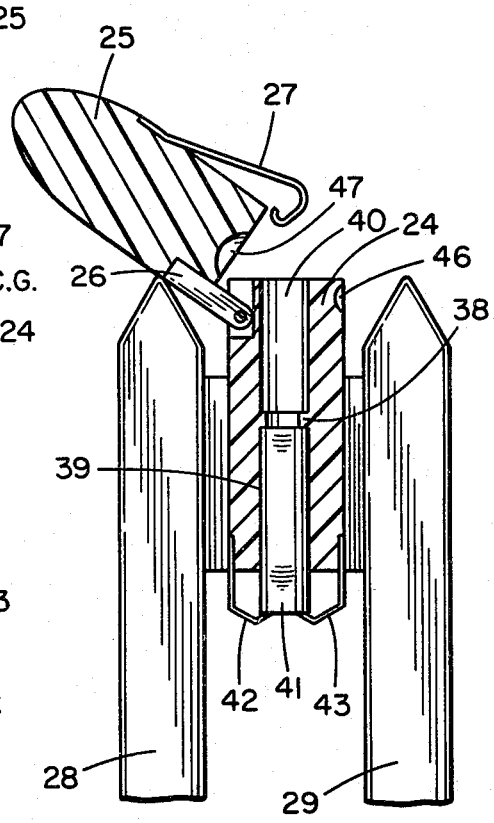
FIG. 12 is a section view taken along line 12—12 of FIG. 11 showing the head in its tilt position with a loaded propellant cartridge chamber.
Figure 13:
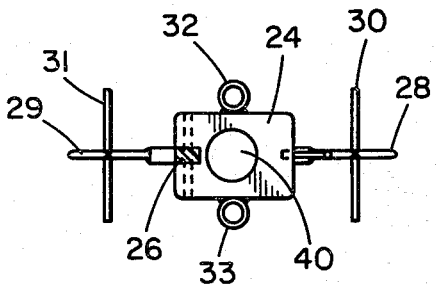
FIG. 13 is a section view taken along line 13—13 of FIG. 10.

Body 24 is formed with an elongated central bore subdivided by an internally projecting ring 38 (FIG. 12) into a propellant cartridge chamber 39 and a retro-fire exhaust chamber 40. A tubular, solid-fuel, propellant cartridge 41 is manually inserted within chamber 39 so that the cartridge rests against ring 38 which serves as a cartridge stop (FIG. 12). Cartridge 41 is retained within chamber 39 by a pair of wire spring clips 42 and 43 during both the thrust and retro-fire explosions hereafter outlined.

Propellant cartridge 41 contains two charges, namely, a rearwardly directed thrust charge which is fired by electric ignition, and a time-delay, retro-fire charge which is ignited automatically after a delay period. The thrust charge produces vertical launch and it elevates flight device 23 through the vertical portion 44 (FIG. 7) extending to apex or crest 45. During launch head 25 is in the latch position (FIG. 10) with latch 27 engaging latch notch 46 (FIG. 12). At about apex 45, the retro-fire charge ignites with the high pressure exhaust passing through exhaust chamber 40 to exert an unlatching force on concave cavity 47 formed at the bottom of head 25. The concave surface of cavity 47 maximizes the effect of the retro explosion.

The force of the retro-fire charge disengages latch 27 from notch 46 enabling head 25 to pivot on hinge 26 to the tilt position shown in FIGS. 7, 8, 9 and 12.

With head 25 in the tilt position, embedded weights 34 and 35 are appropriately in the diagonally opposite quadrants B and D (FIG. 9) necessary to insure gyration portion 48 of the flight path (FIG. 7). The diagram of assistance of FIG. 9 shows elongated metal weight 34 embedded firmly into the left edge of head 25, and irregular metal weight 35 embedded firmly into body 24 and wing 29. In this tilting head disposition, the center of gravity C.G. of flight device 35 is located at the intersection of longitudinal center line 49 (within exhaust cavity 40) and lateral line 50. Lateral line 50 is normal to center line 49, and the two intersecting lines divide the area into four quadrants A, B, C and D. As previously outlined with respect to hand-launched flight 1, the mass of each of the weights must lie effectively in diagonally opposite quadrants; that is, either in quadrants B or D as shown, or alternatively in quadrants A or C.

The vectors of the moment arms generated by tilted weight 34 and weight 35 along the longitudinal center line 49 measured from point C.G. should be oppositely directed. Similarly, the vectors of the moment arms generated by weights 34 and 35 along lateral line 50 measured from point C.G. should also be oppositely directed.

Point C.G. is located on longitudinal center line 49 at a point which is approximately 30% of the total length L (FIG. 11) from the tip of head 25 and 70% from the end of wings 28 and 29. Laterally, point C.G. is located approximately midway of the wing span. There is some allowable tolerance in the longitudinal location of point C.G. to somewhere in the approximate range of 25% to 35% of the length L from the tip of head 25 depending on the flight characteristics desired.

The theory of gyrating flight for flight device 23 is essentially the same as that for flight device 1. Both devices rely on similarly located centers of gravity and weights positioned in diagonally opposite quadrants.

Flight device 23 is readied for launching by placing the device in a vertical attitude on a ground supported platform 51 containing a vertically disposed and platform-fixed launching rod 52. Launching rod 52 engages a launch guide tube 32 or 33 by passing through an associated tube. Flight device 23 is accordingly vertically guided by launch rod 52 during the initial portion of flight.

Ignition of the thrust charge is effected by inserting a conventional electrical hot-wire igniter into propellant cartridge 41. The igniter is connected to power supply 53, and in response to operation of a power supply switch the hot-wire is activated to ignite the thrust charge to launch flight device 23. The retro-fire charge is automatically ignited after the thrust charge is exhausted. The retro-fire explosion tilts head 3 as previously outlined to insure gyrating flight.

It is to be understood, that modifications can be made in the embodiments of the flight devices described without departing from the scope of the invention.

We claim:

1. A toylike symmetrically formed aerial flight device comprising a body, a head projecting forwardly from the body, a pair of sweptback wings projecting rearwardly from the body, and a pair of discrete weight segments fixed to the flight device with each weight segment having a density greater than that of the remaining portions of the flight device providing aerodynamic surfaces and with each segment being effective in diagonally opposite quadrants defined by the longitudinal center line of the flight device and a lateral line normal to the longitudinal center line with the point of origin of the intersecting lines being located approximately at the center of gravity of the flight device.

2. The combination of claim 1 in which the center of gravity of the flight device is located from the foremost portion of the head within the approximate range of 25% to 35% of the length of the flight device.

3. The combination of claim 2 in which one weight segment is fixed to the head.

4. The combination of claim 3 in which the second weight is fixed in substantial part on the body and one of the swept-back wings.

5. The combination of claim 4 in which the head is hinged and latched to the body, and the body has a socket to house a solid-fuel propellant cartridge having a thrust charge which when ignited launches the flight device and a retro-fire charge which when ignited unlatches the entire head as a single unit to effect a tilting motion of the entire head so that the combined weight of the head and its attached weight segment is effective in a diagonally opposite quadrant from that of the second weight.

6. A toylike aerial flight device having a simulated rocket configuration comprising a body formed with a bore longitudinally thereof serving as a socket, a solid fuel propellant cartridge having a thrust charge and a retro-fire charge in said socket, a cone-shaped head projecting forwardly from the body and being hinged and latched to the body, said head when latched closing the forward end of said bore, has a pair of swept-back wings symmetrically disposed relative to the body and projecting rearwardly from the body, and a pair of discrete weight segments the first of which is fixed to the head on one side of the longitudinal center line of the flight device and the second of which is fixed to the flight device on the other side of the longitudinal center line to the rear of the first weight and in which ignition of the thrust charge launches the flight device, and in which the subsequent ignition of the retro-fire charge unlatches the entire head to tilt it as a single unit to a hinged position farther removed laterally from the longitudinal center line to promote gyrating flight.

7. The combination of claim 6 in which the second weight is fixed to the body and one wing and with each weight having a density greater than the portion of the flight device supporting each segment.

8. The combination of claim 7 in which the weight segments are fixed to the flight device with each segment being effective in diagonally opposite quadrants defined by the longitudinal center line of the flight device and a lateral line normal to the longitudinal center line with the point of origin of the intersecting lines being located approximately at the center of gravity of the flight device.

9. The combination of claim 8 in which the center of gravity of the flight device is located from the foremost portion of the head within the approximate range of 25% to 35% of the length of the flight device.

10. A toylike symmetrically formed aerial flight device comprising a body, a head projecting forwardly from the body, a wing structure projecting rearwardly from the body, and a pair of discrete weight segments fixed to the flight device with each weight segment having a density greater than that of the remaining portions of the flight device providing aerodynamic surfaces and with each weight segment being effective in diagonally opposite quadrants defined by the longitudinal center line of the flight device and a lateral line normal to the longitudinal center line with the point of origin of the intersecting lines being located approximately at the center of gravity of the flight device.

11. The combination of claim 10 in which the center of gravity of the flight device is located from the foremost portion of the head within the approximate range of 25% to 35% of the length of the flight device.

12. The combination of claim 11 in which one weight segment is fixed to the head.

13. The combination of claim 12 in which the second weight is fixed in substantial part on the body and the wing structure.

* * * * *

UNITED STATES PATENT AND TRADEMARK OFFICE

CERTIFICATE OF CORRECTION

PATENT NO. : 4,466,213

DATED : August 21, 1984

INVENTOR(S) : Alberico et al.

It is certified that error appears in the above-identified patent and that said Letters Patent is hereby corrected as shown below:

Column 3, line 1, change "launching rod 16" to -- launching rod 15 --

Signed and Sealed this

*Nineteenth* Day of *February 1985*

[SEAL]

*Attest:*

DONALD J. QUIGG

*Attesting Officer*

*Acting Commissioner of Patents and Trademarks*